US010096937B2

(12) United States Patent
Shao et al.

(10) Patent No.: US 10,096,937 B2
(45) Date of Patent: Oct. 9, 2018

(54) QUICK-LOCK RF COAXIAL CONNECTOR

(71) Applicant: CommScope Technologies LLC, Hickory, NC (US)

(72) Inventors: Jiwu Shao, Suzhou (CN); Yujun Zhang, Suzhou (CN); Hongjuan An, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/786,913

(22) Filed: Oct. 18, 2017

(65) Prior Publication Data

US 2018/0123288 A1 May 3, 2018

(30) Foreign Application Priority Data

Oct. 31, 2016 (CN) ..... 2016 1 0927702

(51) Int. Cl.
*H01R 13/625* (2006.01)
*H01R 13/627* (2006.01)
(Continued)

(52) U.S. Cl.
CPC ..... *H01R 13/6277* (2013.01); *H01R 9/0521* (2013.01); *H01R 13/28* (2013.01);
(Continued)

(58) Field of Classification Search
CPC ..... H01R 13/6277; H01R 13/6276; H01R 13/635; H01R 13/639; H01R 13/6275; H01R 24/40
(Continued)

(56) References Cited

U.S. PATENT DOCUMENTS 2,728,895 A 12/1955 Clarke et al.
4,690,494 A 9/1987 Hirose et al.
(Continued)

FOREIGN PATENT DOCUMENTS

CN 2750499 1/2006
CN 101170232 4/2008
(Continued)

OTHER PUBLICATIONS

Notification of Transmittal of the International Search Report and the Written Opinion of the International Searching Authority, or the Declaration for corresponding PCT Application No. PCT/US2017/057109, dated Jan. 26, 2018.
(Continued)

*Primary Examiner* — Xuong Chung Trans
(74) *Attorney, Agent, or Firm* — Myers Bigel, P.A.

(57) ABSTRACT

A quick-lock coaxial connector includes: an inner contact; an outer connector body having a mating section at one end; a dielectric spacer disposed between the inner contact and the outer conductor such that the outer conductor body is coaxial with the inner contact; an unthreaded coupling sleeve that at least partially overlies the outer conductor body; an annular slide block positioned within the outer conductor body; a first biasing member that biases the slide block toward the mating section; a second biasing member that biases the coupling sleeve toward the mating section; and a retaining member captured in the mating section of the outer conductor body and movable radially relative to the mating section, the retaining member configured to interact with the slide block and the coupling sleeve to maintain the coupling sleeve in position relative to the outer conductor body.

20 Claims, 7 Drawing Sheets

(51) Int. Cl.

| | |
|---|---|
| ***H01R 13/639*** | (2006.01) |
| ***H01R 13/52*** | (2006.01) |
| ***H01R 13/28*** | (2006.01) |
| ***H01R 9/05*** | (2006.01) |
| ***H01R 24/40*** | (2011.01) |
| *H01R 24/58* | (2011.01) |
| *H01R 103/00* | (2006.01) |

(52) U.S. Cl.
CPC ..... *H01R 13/52* (2013.01); *H01R 13/639* (2013.01); *H01R 24/40* (2013.01); *H01R 24/58* (2013.01); *H01R 2103/00* (2013.01)

(58) Field of Classification Search
USPC ..... 439/578, 348
See application file for complete search history.

(56) References Cited

U.S. PATENT DOCUMENTS

| | | | | |
|---|---|---|---|---|
| 4,966,560 | A | 10/1990 | Marzouk | |
| 5,281,167 | A | 1/1994 | Le et al. | |
| 5,938,474 | A | 8/1999 | Nelson | |
| 6,267,612 | B1 | 7/2001 | Arckiewicz et al. | |
| 6,471,545 | B1 | 10/2002 | Hosler, Sr. | |
| 6,619,876 | B2 | 9/2003 | Vaitkus et al. | |
| 6,709,289 | B2 | 3/2004 | Huber et al. | |
| 6,786,767 | B1 | 9/2004 | Fuks et al. | |
| 6,824,415 | B2 * | 11/2004 | Wlos ..... | H01R 13/6276 439/348 |
| 7,032,931 | B2 | 4/2006 | Austin | |
| 7,131,868 | B2 | 11/2006 | Montena | |
| 7,527,524 | B1 | 5/2009 | Coleman et al. | |
| 7,635,283 | B1 | 12/2009 | Islam | |
| 7,731,529 | B1 | 6/2010 | Islam | |
| 7,785,144 | B1 | 8/2010 | Islam | |
| 7,850,472 | B2 | 12/2010 | Friedrich et al. | |
| 7,914,311 | B1 | 3/2011 | Gallusser et al. | |
| 8,408,938 | B2 | 4/2013 | Proeckl | |
| 8,506,325 | B2 * | 8/2013 | Malloy ..... | H01R 13/187 439/578 |
| 8,764,473 | B2 * | 7/2014 | Komatsubara ..... | H01R 13/6276 439/348 |
| 9,024,191 | B2 | 5/2015 | Paynter et al. | |
| 9,108,348 | B2 | 8/2015 | Van Swearingen et al. | |
| 9,306,346 | B2 | 4/2016 | Vaccaro et al. | |
| 9,484,645 | B2 * | 11/2016 | Matzen ..... | H01R 24/38 |
| 9,692,191 | B2 * | 6/2017 | Tatzel ..... | H01R 13/24 |
| 2004/0067675 | A1 | 4/2004 | Heebe et al. | |
| 2005/0118865 | A1 | 6/2005 | Henningsen | |
| 2007/0087612 | A1 | 4/2007 | Tsujita | |
| 2010/0199493 | A1 | 8/2010 | Chansrivong | |
| 2011/0130048 | A1 | 6/2011 | Haunberger et al. | |
| 2012/0255991 | A1 | 10/2012 | Swearingen | |
| 2013/0084738 | A1 | 4/2013 | Van Swearingen et al. | |
| 2013/0157487 | A1 | 6/2013 | Heebe et al. | |
| 2015/0024628 | A1 | 1/2015 | Haegele et al. | |
| 2015/0118897 | A1 | 4/2015 | Paynter et al. | |

FOREIGN PATENT DOCUMENTS

| | | | |
|---|---|---|---|
| FR | 2478882 | A1 | 9/1981 |
| JP | H11354219 | | 12/1999 |
| JP | 2008198605 | A | 8/2006 |

OTHER PUBLICATIONS

International Search Report for corresponding PCT Application No. PCT/CN2014/071971, dated Nov. 18, 2014, 4 pages.

Extended European Search Report corresponding to European Application No. 14882519.3, dated Aug. 30, 2017.

* cited by examiner

QUICK-LOCK RF COAXIAL CONNECTOR

RELATED APPLICATION

The present application claims priority from and the benefit of Chinese Application No. 201610927702.3, filed Oct. 31, 2016, the disclosure of which is hereby incorporated herein in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

"Quick-connect" coaxial connectors rely on a mechanism for maintaining contact between mated conductors that eliminates the multiple rotations of a threaded coupling nut. However, such connectors may suffer from unreliable performance due to inconsistent contact between conductors of the connectors. In addition, many quick-connect coaxial connectors are configured such that they may only be connected to specific mating quick-connect connectors; thus, they are unable to be used with some standard connectors that may already be in the field.

A new proposed 4.3/10 interface under consideration by the IEC (46F/243/NP) (hereinafter the 4.3/10 interface) is alleged to exhibit superior electrical performance and improved (easier) mating. The 4.3/10 interface includes the following features: (a) separate electrical and mechanical reference planes; and (b) radial (electrical) contact of the outer conductor, so that axial compression is not needed for high normal forces. An exemplary configuration is shown in FIG. 1 and is described in detail below. The alleged benefits of this arrangement include:

- Increased mechanical stability, as the mechanical reference plane is now outside the RF path;
- Non-bottoming of the electrical reference plane (as contact is made in the radial direction)—therefore, normal (radial) forces are independent from coupling nut torque applied;
- Coupling nut torque reduction;

- Improvement in passive intermodulation (PIM) performance as outer contact radial forces are independent of coupling nut torque applied; and
- Gang mating of several connectors as the electrical reference plane can float (axially). Therefore, tolerance stack-ups from connector to connector should have no effect.

It may be desirable to provide quick-lock connector designs that conform to the proposed 4.3/10 interface standard.

SUMMARY

As a first aspect, embodiments of the invention are directed to a quick-lock coaxial connector comprising: an inner contact; an outer connector body having a mating section at one end; a dielectric spacer disposed between the inner contact and the outer conductor such that the outer conductor body is coaxial with the inner contact; a coupling sleeve that at least partially overlies the outer conductor body; an annular slide block positioned within the outer conductor body; a first biasing member that biases the slide block toward the mating section; a second biasing member that biases the coupling sleeve toward the mating section; and a retaining member captured in the mating section of the outer conductor body and movable radially relative to the mating section, the retaining member configured to interact with the slide block and the coupling sleeve to maintain the coupling sleeve in position relative to the outer conductor body. In an unmated condition, the first biasing member urges the slide block to engage the retaining member, and the coupling sleeve is in a first position relative to the outer conductor body, and in a mated condition, a mating connector forces the slide block away from the retaining member, and the second biasing member urges the coupling sleeve against the retaining member such that the coupling sleeve is in a second position relative to the outer conductor body that is advanced in a direction toward the mating connector.

As a second aspect, embodiments of the invention are directed to a quick-lock coaxial connector comprising: an inner contact; an outer connector body having a mating section at one end; a dielectric spacer disposed between the inner contact and the outer conductor such that the outer conductor body is coaxial with the inner contact; an unthreaded coupling sleeve that at least partially overlies the outer conductor body; an annular slide block positioned within the outer conductor body; a first biasing member that biases the slide block toward the mating section; a second biasing member that biases the coupling sleeve toward the mating section; and a retaining member captured in the mating section of the outer conductor body and movable radially relative to the mating section, the retaining member configured to interact with the slide block and the coupling sleeve to maintain the coupling sleeve in position relative to the outer conductor body.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
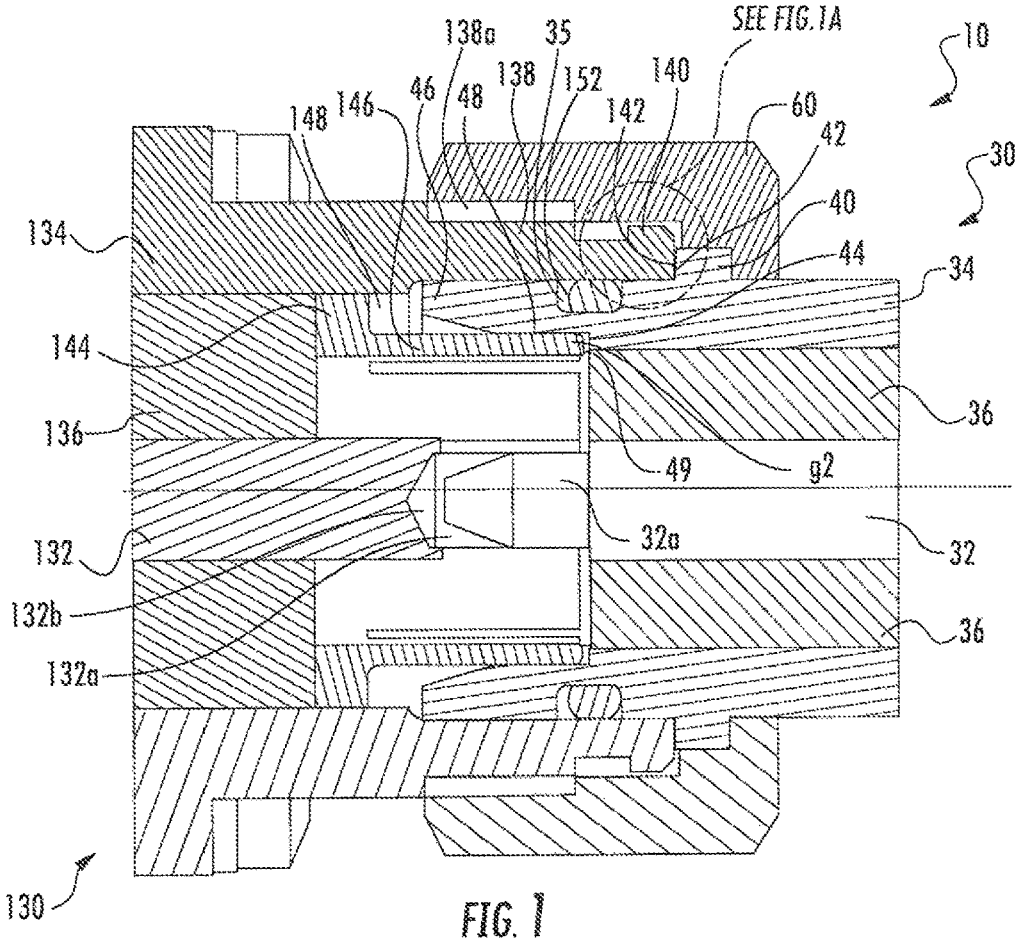
FIG. 1 is a side section view of exemplary mated connectors that conform to the IEC 4.3/10 interface standard.

Referring now to FIG. 1, a cross-section of a basic 4.3/10 interface configuration is shown therein and is designated broadly at 10. The interface 10 includes a plug 30 that is to be connected with a mating jack 130 of the mating coaxial cable. FIG. 1 shows the plug 30 and jack 130 in their mated condition.

The plug 30 includes an inner contact 32, an outer conductor body 34, and a dielectric spacer 36. The inner contact 32 has a generally cylindrical post 32*a* with a conical free end and is configured to be attached at its opposite end to the inner conductor of a coaxial cable (not shown). Similarly, the outer conductor body 34 is configured to be mounted in electrical contact with the outer conductor of a coaxial cable (not shown). The free end portion 46 of the outer conductor body 34 is bevelled to facilitate insertion of the jack 130. The outer conductor body 34 also includes a radially-extending shoulder 40 with a bearing surface 42 that faces the jack 130. The outer conductor body 34 also includes a recess 44 on its radially-inward surface that provides a surface 48 that faces the jack 130. The dielectric spacer 36 (which is annular in shape) is positioned between the inner contact 32 and the outer conductor body 34.

Referring again to FIG. 1, the jack 130 includes an inner contact 132, an outer conductor body 134, and a dielectric spacer 136. The inner contact 132 is configured to be mounted to and in electrical contact with the inner conductor of a second coaxial cable. The inner contact 132 is hollow at its free end, forming a cavity 132*a* with a bevelled end 132*b*. The outer conductor body 134 is configured to be mounted to and in electrical contact with the outer conductor of the aforementioned second coaxial cable. The outer conductor body 134 includes a main sleeve 138 with a free end portion 140. The free end portion 140 includes a bearing surface 142. The outer conductor body 134 also includes an inner spring basket 144 that is positioned radially inwardly from the main sleeve 138 and abuts the dielectric spacer 136. Fingers 146 of the spring basket 144 extend toward the plug 30, such that a gap 148 is formed between the fingers 146 and the free end portion 140 of the outer sleeve 138. The dielectric spacer 136 is positioned between the inner contact 132 and the outer conductor body 134.

An O-ring 152 is located within an annular recess 35 in the outer conductor body 34 to provide a seal to the interface when the plug 30 and jack 130 are mated. Also, a coupling nut 60 is captured by the shoulder 40 of the outer conductor body 34 and mates with threads 138*a* on the outer sleeve 138 of the outer conductor body 134 to secure the mated plug 30 and jack 130.

Referring still to FIG. 1, when the plug 30 and jack 130 are mated, the post 32*a* is inserted into the cavity 132*a* to establish an electrical connection therebetween. Also, the free end 46 of the outer conductor body 34 is inserted into the gap 148 of the outer conductor body 134 to establish an electrical connection therebetween. More specifically, electrical connection is established between the fingers 146 of the spring basket 144 and the radially inward surface of the free end portion 46 of the outer conductor body 34. The gap 148 and free end 46 are sized such that insertion of the free end 46 therein causes the fingers 146 to flex radially inwardly, thereby exerting radially outward pressure on the inner surface 48 of the free end portion 46 to establish an electrical connection.

Figure 1A:
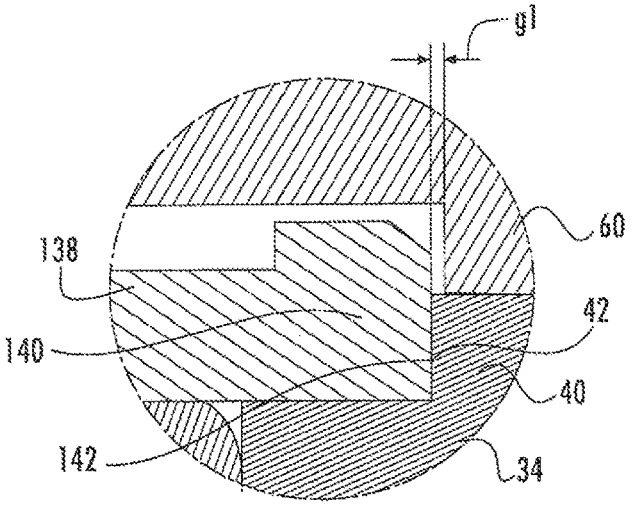
FIG. 1A is a greatly enlarged side section view of a portion of FIG. 1.

Notably, when the plug 30 and jack 130 are mated, the bearing surface 142 of the free end 140 of the outer sleeve 138 contacts the bearing surface 42 of the shoulder 40 of the outer conductor body 34, but does not contact the coupling nut 60, which is prevented from further movement toward the jack 130 by the shoulder 40. As can be seen in FIG. 1A, this arrangement causes a gap g1 between the coupling nut 60 and the free end 140 of the outer sleeve 138, such that the mechanical "stop" (sometimes called the "mechanical reference plane") is created by the bearing surface 142 and the bearing surface 42. As a result, and as can be seen in FIG. 1, a small gap g2 exists between the free ends of the fingers 146 and the surface 49 of the recess 44 of the outer conductor body 34. The presence of this gap g2 indicates that electrical contact between the fingers 146 and the free end portion 46 of the outer conductor body 34 is established by radial, not axial, contact between these components, and that the "electrical reference plane" created by such contact is offset from the mechanical reference plane described above. This arrangement is consistent with the specifications set forth for IEC 4.3/10 interfaces.

Figure 2:
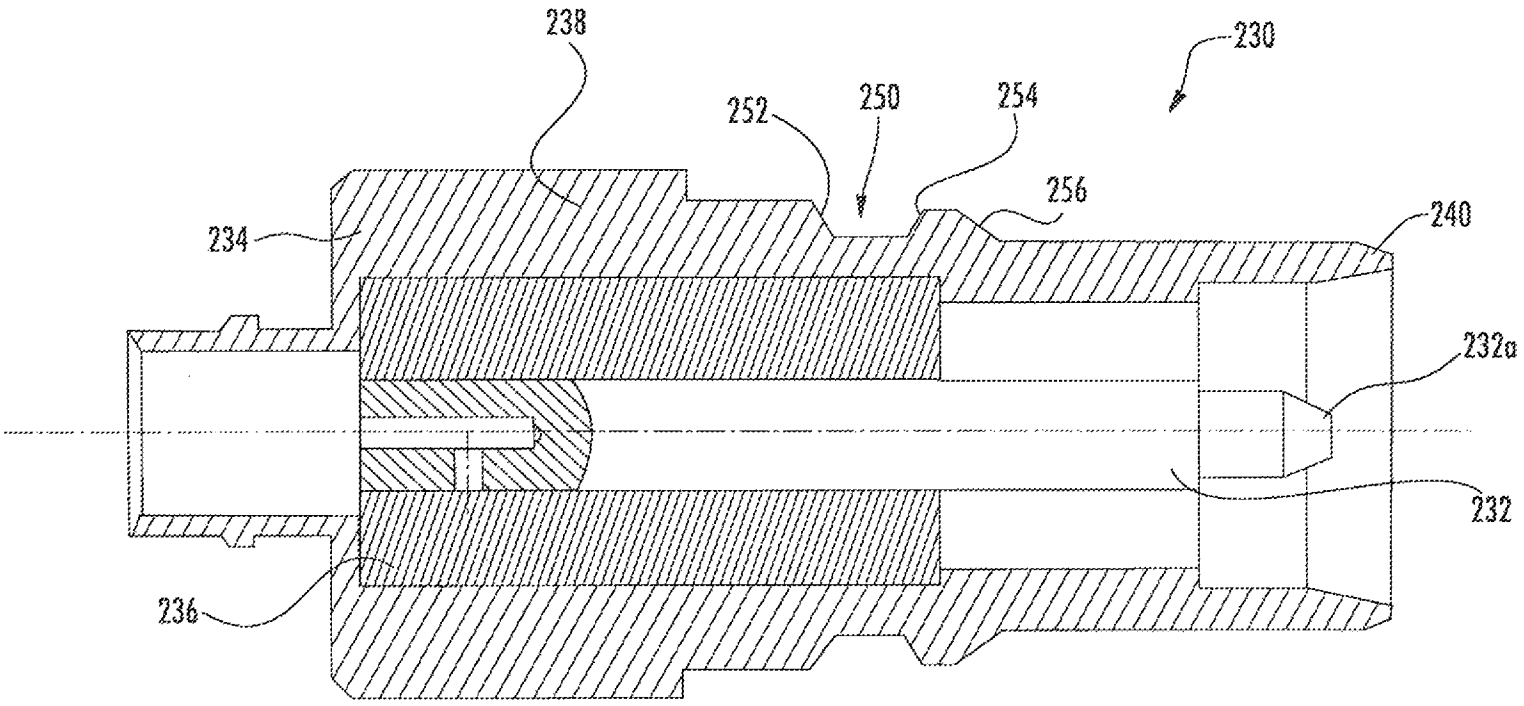
FIG. 2 is a side section view of a 4.3/10 male connector according to embodiments of the invention.
Figure 3:
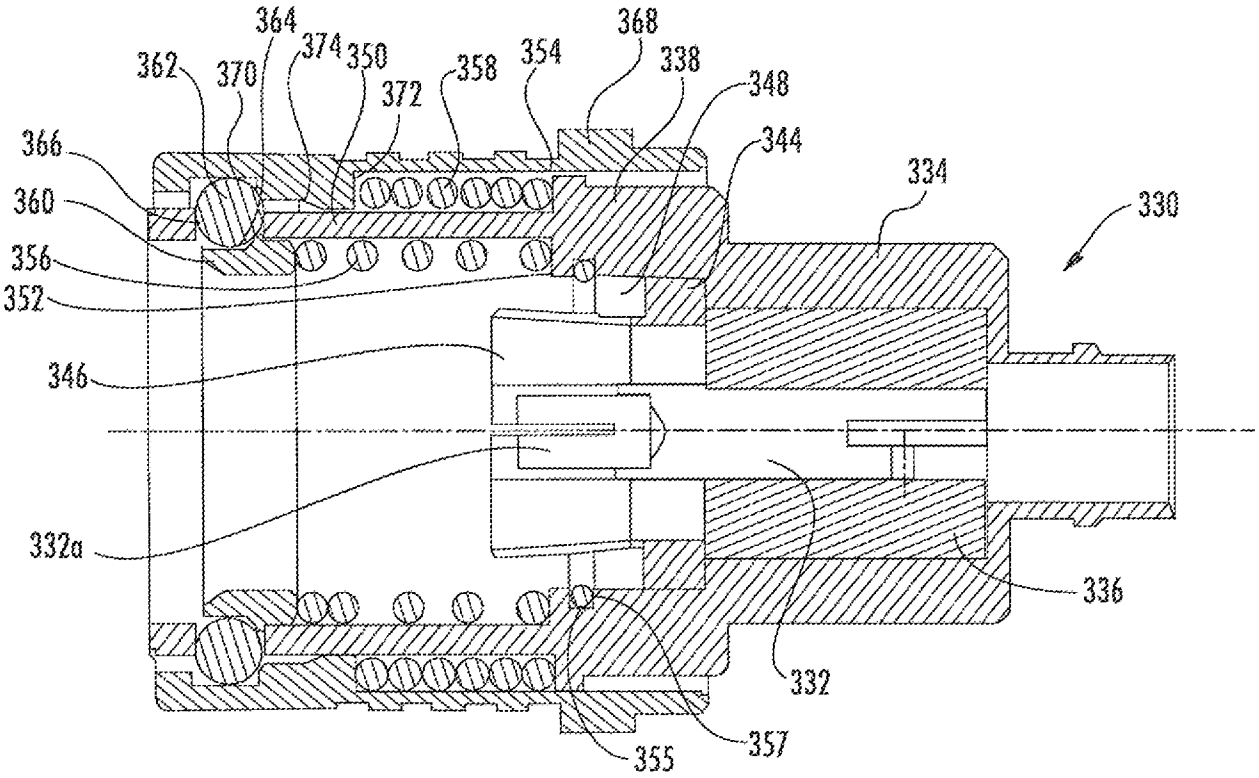
FIG. 3 is a side section view of a 4.3/10 female connector according to embodiments of the invention.
Figure 4:
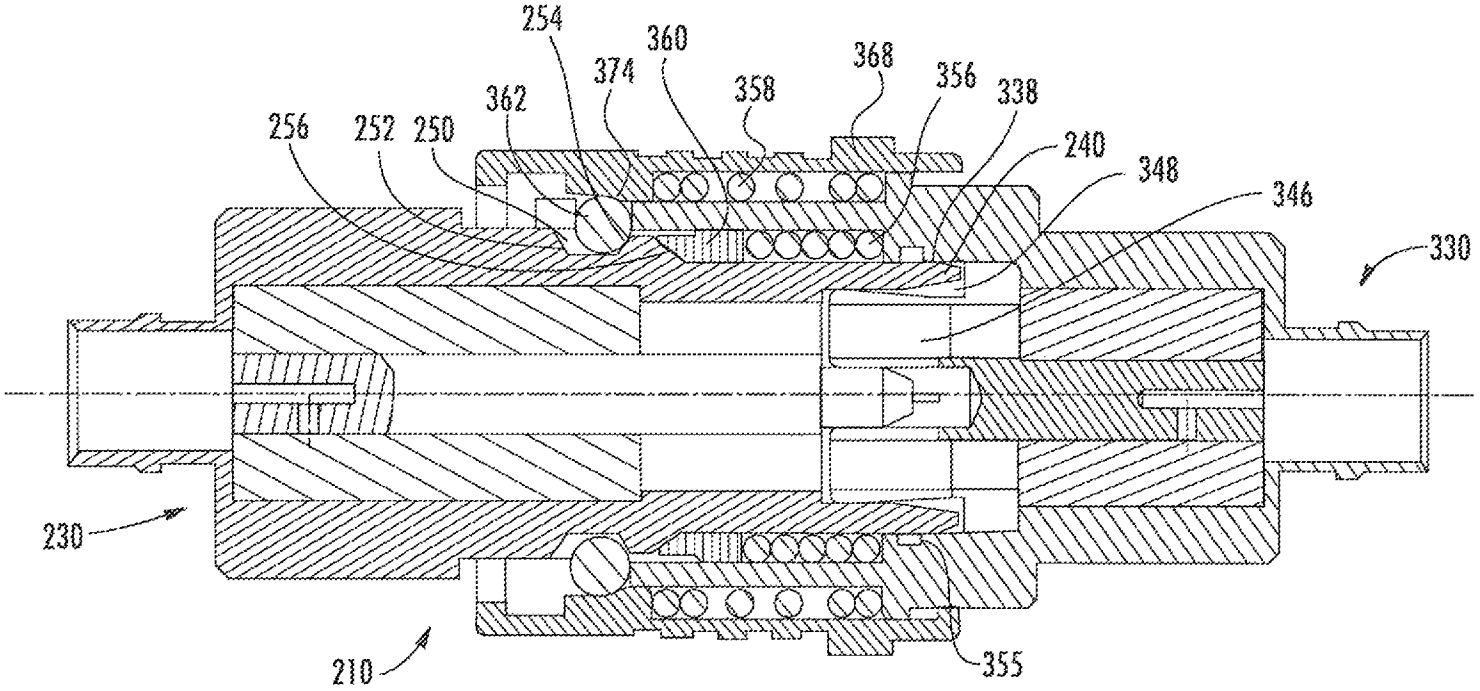
FIG. 4 is a side section view of the male and female connectors of FIGS. 2 and 3 in a mated condition.

Referring now to FIGS. 2-4, an interface 210 that meets the IEC 4.3/10 standard, but also has quick-lock capability, is shown therein. The interface 210 includes a male connector 230 and a female connector 330. The male connector 230 includes an inner contact 232 with a post 232*a*, an outer conductor body 234, and a dielectric spacer 236. The main sleeve 238 of the outer conductor body 234 has a stepped outer profile divided into three sections, with a ring groove 250 on the outer surface of the middle section that is bounded by angled surfaces 252, 254. A ramped surface 256 is present forwardly of the groove 250. The free end of the outer sleeve 238 has a free end portion 240 that is configured to mate with the female connector 330.

The female connector 330 includes an inner contact 332, an outer conductor body 334, and a dielectric spacer 336. The inner contact 332 has a cavity 332*a* configured for mating with the post 232*a* of the inner contact 232 of the male connector 230. The outer conductor body 334 has a main outer body 338 and a spring basket 344 with spring fingers 346, with gap 348 formed between the outer body 338 and the fingers 346. The dielectric spacer 336 is located between the inner contact 332 and the outer conductor body 334.

The main outer body 338 has a mating section 350 extending from an inner shoulder 352 and an outer shoulder 354. An inner spring 356 is located adjacent the inner surface of the mating section 350 abutting the inner shoulder 352. An outer spring 358 encircles the outer surface of the mating section 350 abutting the outer shoulder 354. An annular slide block 360 is positioned within the mating section 350 at the end of the inner spring 356 away from the inner shoulder 352. Four steel balls 362 (two are shown in FIGS. 3 and 4) are positioned in pockets 366 in the mating section 350. The slide block 360 includes a recess 364 in its outer surface that contacts the bails 362. Also, an o-ring 355 is present in a groove 357 on the inner surface of the main outer body 338.

A coupling sleeve 368 (ordinarily unthreaded) encircles the mating section 350. An inner groove 370 in the inner surface of the coupling sleeve 368 is configured to receive the balls 362. A shoulder 372 is present on the inner surface of the coupling sleeve 368 and abuts the end of the outer spring 358 opposite the outer shoulder 354. An angled bearing surface 374 is positioned between the shoulder 372 and the inner groove 370.

In its unmated condition (FIG. 3), the coupling sleeve 368 of the female connector 330 is positioned relative to the outer conductor body 334 such that the balls 362 are received in the inner groove 370 of the coupling sleeve 368. In this position, the outer spring 358 is collapsed between the outer shoulder 354 of the main outer body 338 and the shoulder 372 of the coupling sleeve 368. The inner spring 356 provides a slight bias on the slide block 360 so that the balls 362 are received in the recess 364.

When mating the male and female connectors 230, 330 (FIG. 4), the free end portion 240 of the male connector 230 is received in the gap 348 between the fingers 346 and the main outer body 338. The o-ring 355 provides a seal between the free end portion 240 and the main outer body 338. As the male connector 230 slides toward the female connector 330, the ramped surface 256 contacts the slide block 360 and forces it away from the balls 362 and deeper into the female connector 330 (the inner spring 356 resists this movement). As the slide block 360 moves away from the balls 362, the balls 362 are free to move radially inwardly. Continued movement of the male connector 230 into the female connector 330 eventually moves the angled surface 254 under the balls 362, with the result that the balls 362 slide down the angled surface 254 and into the groove 250 of the male connector 230. Once the balls 362 are in position in the groove 250, the coupling sleeve 368 is slid or otherwise advanced relative to the outer conductor body 334 toward the male connector 230 until the bearing surface 374 contacts the balls 362; the outer spring 358 forces the balls 362 against the angled surface 252 of the grooves 250 through the bearing surface 374. At this point the connectors 230, 330 are fully mated: the interactions between (a) the bearing surface 374 and the balls 362 (maintained by the outer spring 358) and (b) the slide block 360 and the ramped surface 256 (maintained by the inner spring 356) maintain the balls 362 in the groove 250, which in turn prevents the connectors 230, 330 from disengaging. Such mating is accomplished with a "quick-lock" action rather than a rotation/threading action, rendering the mating of the connectors 230, 330 simpler and faster than typical threaded connectors.

Those of skill in this art will appreciate that other variations of the mating connectors 230, 330 may be suitable. For example, the inner and outer springs 356, 358 may be differently configured (e.g., they may be leaf springs, resilient rubber or foam, or another biasing structure). The balls 362 may be replaced with other retention members, such as tubes, dowels, or the like. The slide block 360 may have a recess that is circumferentially continuous or discontinuous. Other variations may also be employed.

Figure 5:
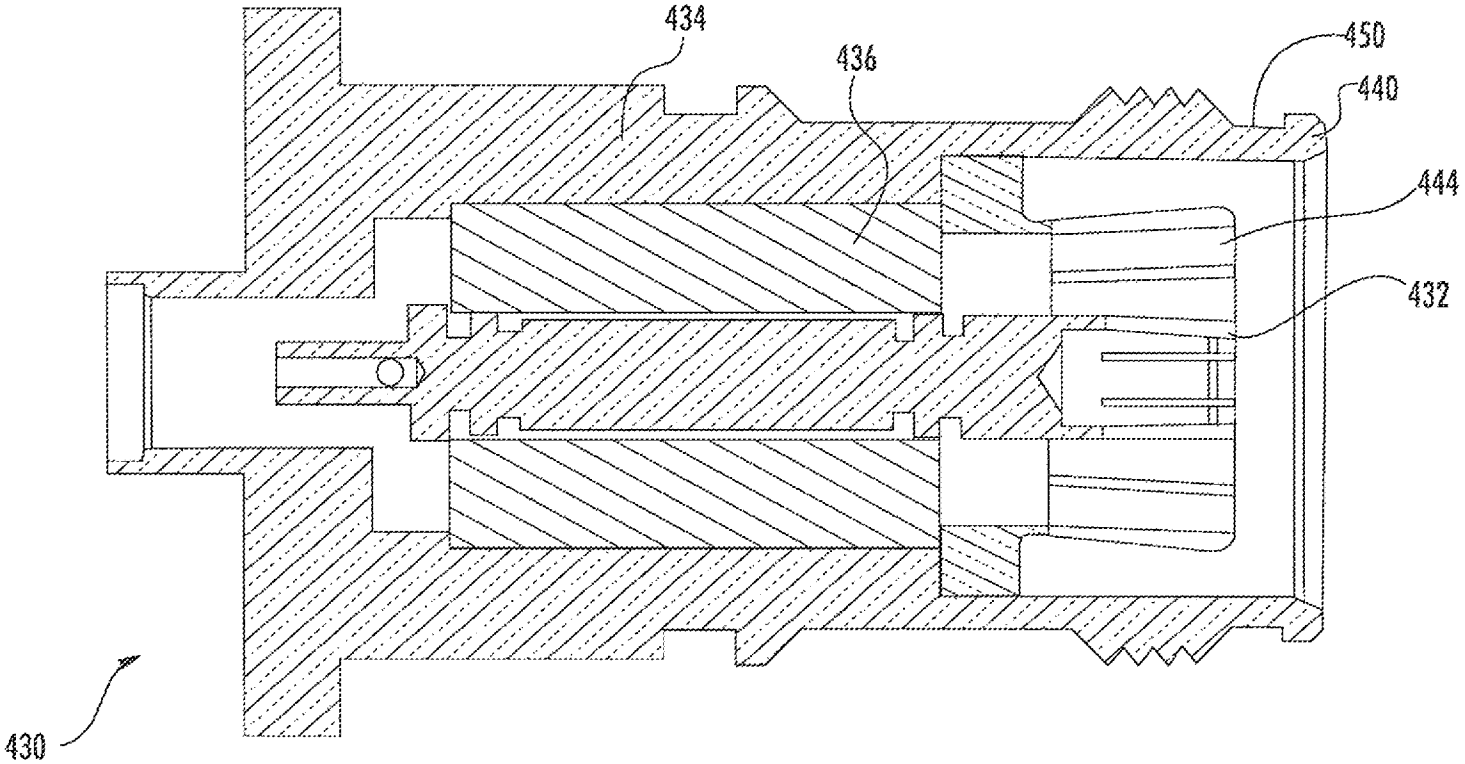
FIG. 5 is a side section view of a 4.3/10 female connector according to embodiments of the invention.
Figure 6:
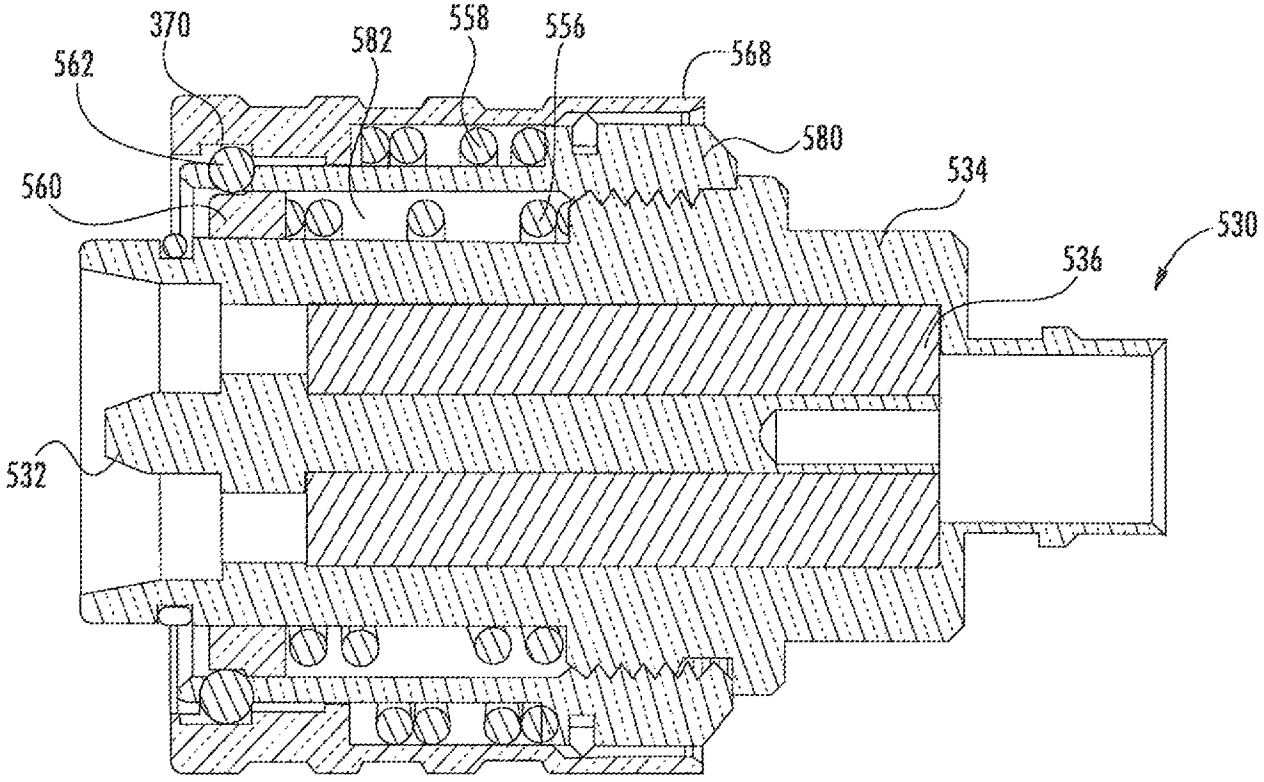
FIG. 6 is a side section view of a 4.3/10 male connector according to embodiments of the invention.
Figure 7:
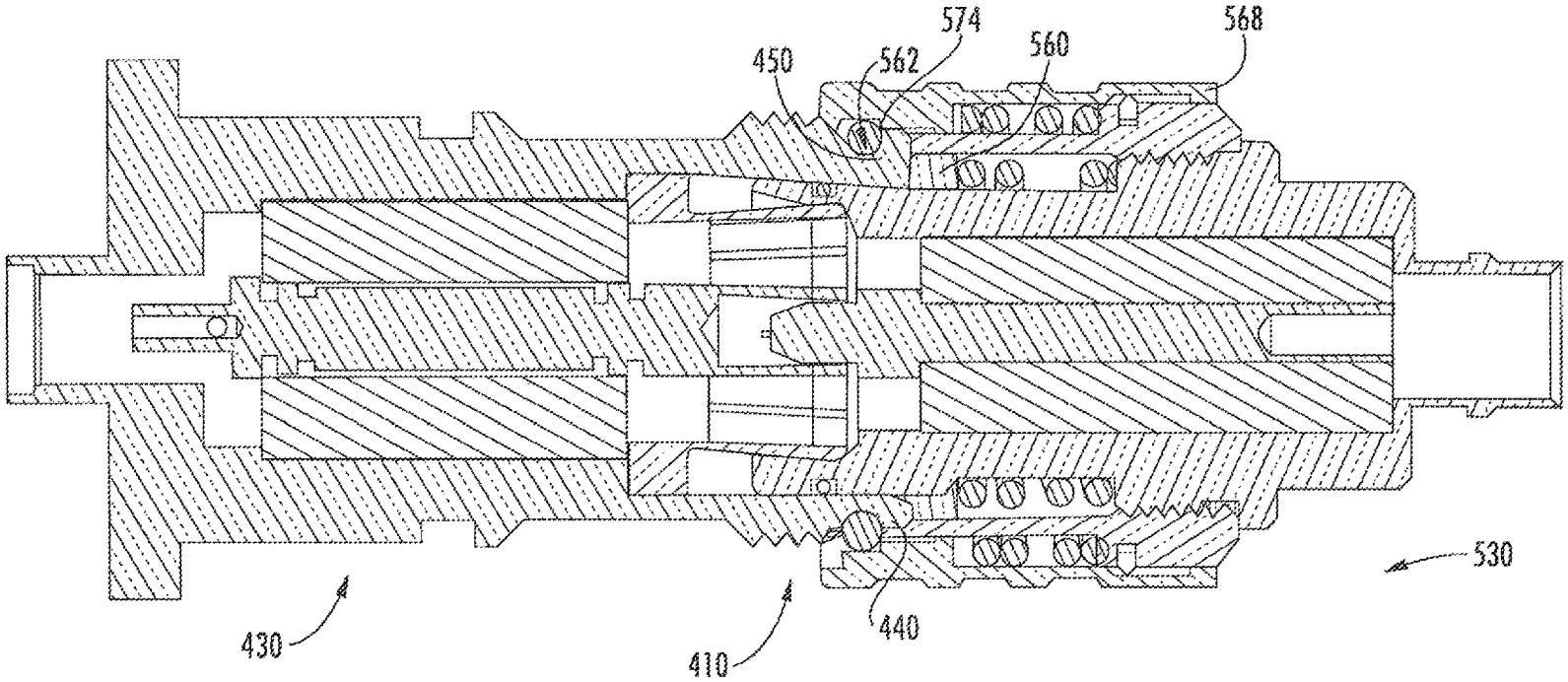
FIG. 7 is a side section view of the male and female connectors of FIGS. 5 and 6 in a mated condition.

Referring now to FIGS. 5-7, additional embodiments of two mating quick-lock connectors, designated broadly at 430, 530, are shown therein as interface 410. As will be apparent from examination of FIGS. 5-7, in this embodiment, the coupling sleeve 568 is mounted on the male connector 530 (rather than the female connector 430). Some other differences in the connectors 430, 530 are described below.

Referring to FIG. 5, the female connector 430 has an inner contact 432, a dielectric spacer 436 and a spring basket 444 similar to those described above in connection with the female connector 330. The inner surface of the outer conductor body 434 is similar to that of the outer conductor body 334, but the outer surface of the outer conductor body 434 has a groove 450 near the free end of its mating section 440 that is similar to the groove 250 discussed above.

Referring now to FIG. 6, the male connector 530 has an inner contact 532 and a dielectric spacer 536 that are similar to the inner contact and spacer 232, 236 described above. The outer conductor body 534 has an inner surface that is similar to that of the outer conductor body 234. However, the male connector 530 also includes a supplemental outer body 580 that partially overlies the outer conductor body 534. A gap 582 is present between the outer conductor body 534 and the supplemental outer body 580. The inner spring 556 and the slide block 560 reside in the gap 582. The balls 562 are captured in the supplemental outer body 580. The outer spring 558 encircles the supplemental outer body 580, with the coupling sleeve 568 overlying much of the supplemental outer body 580 and capturing the balls 562 in an inner groove 370 when the connectors 430, 530 are in an unmated condition (as in FIG. 6).

When the connectors 430, 530 are mated (FIG. 7), the quick-locking action is very similar to that of the connectors 230, 330. The mating section 440 of the female connector 430 contacts the slide block 560 and forces it rearwardly; this action continues until the groove 450 reaches the balls 562 and captures them. The coupling sleeve 568 is then pushed forwardly so that the angled inner surface 574 of the coupling sleeve 568 presses against the balls 562 and maintains them in the groove 450. Once this occurs, the connectors 439, 530 are locked.

Those of skill in this art will appreciate that other variations of the mating connectors 430, 430 may be employed. For example, as discussed above, the inner and outer springs 556, 558 may be differently configured, and/or the balls 562 may be replaced with other retention members. The slide block 560 may, have a recess that is circumferentially continuous or discontinuous. Other variations may also be employed.

Moreover, those skilled in this art will appreciate that, although the connectors 230, 330, 430, 530 shown herein meet the IEC 4.3/10 standard, other types of connectors that may benefit from a "quick-lock" configuration may also be used. As examples, DIN, F-type, and N-type connectors may be used.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A quick-lock coaxial connector, comprising:

an inner contact;

an outer connector body having a mating section at one end;

a dielectric spacer disposed between the inner contact and the outer conductor such that the outer conductor body is coaxial with the inner contact;

a coupling sleeve that at least partially overlies the outer conductor body;

an annular slide block positioned within the outer conductor body;

a first biasing member that biases the slide block toward the mating section;

a second biasing member that biases the coupling sleeve toward the mating section;

a retaining member captured in the mating section of the outer conductor body and movable radially relative to the mating section, the retaining member configured to interact with the slide block and the coupling sleeve to maintain the coupling sleeve in position relative to the outer conductor body;

wherein in an unmated condition, the first biasing member urges the slide block to engage the retaining member, and the coupling sleeve is in a first position relative to the outer conductor body, and in a mated condition, a mating connector forces the slide block away from the retaining member, and the second biasing member urges the coupling sleeve against the retaining member such that the coupling sleeve is in a second position relative to the outer conductor body that is advanced in a direction toward the mating connector.

2. The coaxial connector defined in claim 1, wherein the retaining member is generally spherical.

3. The coaxial connector defined in claim 1, wherein at least one of the first biasing member and the second biasing member is a spring.

4. The coaxial connector defined in claim 1, wherein in the mated condition, the retaining member resides in a groove in an outer conductor body of the mating connector.

5. The coaxial connector defined in claim 1, wherein the coupling sleeve includes an angled bearing surface that engages the retaining member in the mated condition.

6. The coaxial connector defined in claim 1, wherein the slide block includes a recess, and wherein the retaining member resides in the recess in the unmated condition.

7. The coaxial connector defined in claim 1, wherein the connector meets the standard defined in IEC 4.3/10.

8. The coaxial connector defined in claim 1, further comprising a spring basket positioned within the outer conductor body.

9. The coaxial connector defined in claim 1, in combination with the mating connector, wherein the coaxial connector is a first connector and the mating connector is a second connector.

10. The combination defined in claim 9, wherein the second connector includes an outer conductor body having a groove.

11. The combination defined in claim 10, wherein the retaining member resides in the groove in the mated condition.

12. The combination defined in claim 11, wherein the retaining member is generally spherical.

13. The combination defined in claim 9, wherein at least one of the first biasing member and the second biasing member is a spring.

14. The combination defined in claim 9, wherein the coupling sleeve includes an angled bearing surface that engages the retaining member in the mated condition.

15. The combination defined in claim 9, wherein the slide block includes a recess, and wherein the retaining member resides in the recess in the unmated condition.

16. The combination defined in claim 9, wherein the first and second connectors meet the standard defined in IEC 4.3/10.

17. The combination defined in claim 9, further comprising a spring basket with fingers positioned within the outer conductor body of the first connector, and wherein the outer conductor body of the second connector includes a mating portion that, in the mated condition, resides between the outer conductor body and the fingers.

18. The combination defined in claim 9, wherein the first connector is a female connector.

19. The combination defined in claim 9, wherein the first connector is a male connector.

20. A quick-lock coaxial connector, comprising:

an inner contact;

an outer connector body having a mating section at one end;

a dielectric spacer disposed between the inner contact and the outer conductor such that the outer conductor body is coaxial with the inner contact;

an unthreaded coupling sleeve that at least partially overlies the outer conductor body;

an annular slide block positioned within the outer conductor body;

a first biasing member that biases the slide block toward the mating section;

a second biasing member that biases the coupling sleeve toward the mating section; and a retaining member captured in the mating section of the outer conductor body and movable radially relative to the mating section, the retaining member configured to interact with the slide block and the coupling sleeve to maintain the coupling sleeve in position relative to the outer conductor body.

* * * * *